US008400483B2

(12) United States Patent
Ochiai

(10) Patent No.: US 8,400,483 B2
(45) Date of Patent: Mar. 19, 2013

(54) PRINTER, METHOD FOR RELEASING PRESSURE CONTACT OF HEATING BODY

(75) Inventor: Teruyuki Ochiai, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 349 days.

(21) Appl. No.: 12/894,419

(22) Filed: Sep. 30, 2010

(65) Prior Publication Data

US 2011/0216145 A1 Sep. 8, 2011

(30) Foreign Application Priority Data

Mar. 4, 2010 (JP) ..... 2010-47872

(51) Int. Cl.
*B41J 29/16* (2006.01)

(52) U.S. Cl. ..... 347/179

(58) Field of Classification Search ..... 347/171, 347/179, 223, 104, 105; 400/120.01; 399/4, 399/186; 250/316.1, 317.1
See application file for complete search history.

(56) References Cited

U.S. PATENT DOCUMENTS 5,683,189 A * 11/1997 Sukigara et al. ..... 347/179
6,152,620 A * 11/2000 Ozawa et al. ..... 347/179
6,860,658 B2 * 3/2005 Tischer ..... 347/179

FOREIGN PATENT DOCUMENTS

JP 2002-287586 10/2002

* cited by examiner

*Primary Examiner* — Kristal Feggins
(74) *Attorney, Agent, or Firm* — Turocy & Watson, LLP

(57) ABSTRACT

A printer includes a conveying unit for conveying a rewritable printing medium toward a discharging portion along a conveying path, and the rewritable printing medium is erasable and printable by applying heat energy to the rewritable printing medium. The printer further includes an erasing unit including a heating body for erasing print of the rewritable printing medium by pressing the heating body to be in pressure contact with the rewritable printing medium, a printing unit for printing the rewritable printing medium, a determination unit for determining whether an abnormality occurs in conveyance of the rewritable printing medium, and a control unit for controlling at least one of the erasing unit and the conveying unit for releasing the pressure contact of the heating body on the rewritable printing medium, if the determination unit determines that an abnormality occurs.

20 Claims, 8 Drawing Sheets

PRINTER, METHOD FOR RELEASING PRESSURE CONTACT OF HEATING BODY

CROSS-REFERENCE TO RELATED APPLICATIONS

This application is based upon and claims the benefit of priority from Japanese Patent Application No. 2010-047872, filed on Mar. 4, 2010, the entire contents of which is incorporated herein by reference.

FIELD

Embodiments described herein relate generally to a printer and a method of releasing the pressure contact of a heating body.

BACKGROUND

In the related art, printers perform a print erasing operation and a printing operation on a rewritable printing medium by applying heat energy to the rewritable printing medium such as a rewritable paper.

The printer erases the print of a rewritable printing medium by pressing a heat roller of an erasing unit to be in pressure contact with the rewritable printing medium and heating the rewritable printing medium by the heat roller. Subsequently, the printer erases the print of another rewritable printing medium.

Accordingly, if one rewritable printing medium, as a print target, is jammed, another rewritable printing medium, as an erasure target, is also affected and the rewritable printing medium as the erasure target stops to be conveyed and erased.

DETAILED DESCRIPTION

According to one embodiment, a printer includes a conveying unit for conveying a rewritable printing medium toward a discharging portion along a conveying path, and the rewritable printing medium is erasable and printable by applying heat energy to the rewritable printing medium. The printer further includes an erasing unit including a heating body for erasing print of the rewritable printing medium by pressing the heating body to be in pressure contact with the rewritable printing medium, a printing unit for printing the rewritable printing medium, an determination unit for determining whether an abnormality occurs in conveyance of the rewritable printing medium, and a control unit for controlling at least one of the erasing unit and the conveying unit for releasing the pressure contact of the heating body on the rewritable printing medium, if the determination unit determines that an abnormality occurs.

Embodiments will now be described in detail with reference to the accompanying drawings.

First Embodiment

First, the first embodiment will be described with reference to FIGS. 1 to 7. A printer 1 shown in FIG. 1 prints and discharges a rewritable printing medium 200 shown in FIG. 2.

Figure 2:
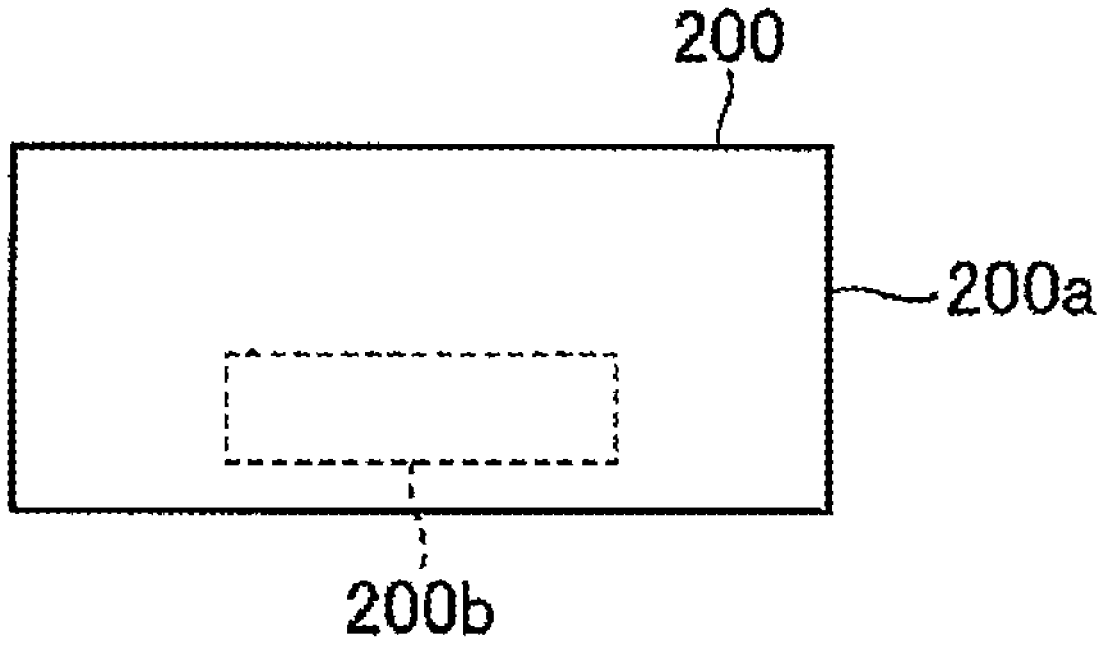
FIG. 2 is a top view showing a rewritable printing medium.

The rewritable printing medium 200 may be subject to heat energy, so that the rewritable printing medium 200 can be printed and the print of the rewritable printing medium 200 can be erased. For example, the rewritable printing medium 200 is a rectangular single sheet viewed from the top, as shown in FIG. 2. The rewritable printing medium 200 may include a resin base 200*a* and a wireless chip 200*b* built in the base 200*a*. A reversible thermo-sensitive recording layer including a leuco dye or a color developer is covered on the base 200*a*. The reversible thermo-sensitive recording layer has the characteristics of print being fixed by rapid cooling after heating, and print being erased by slow cooling after heating. In this embodiment, the wireless chip is an RFID (Radio Frequency Identification) chip.

Figure 1:
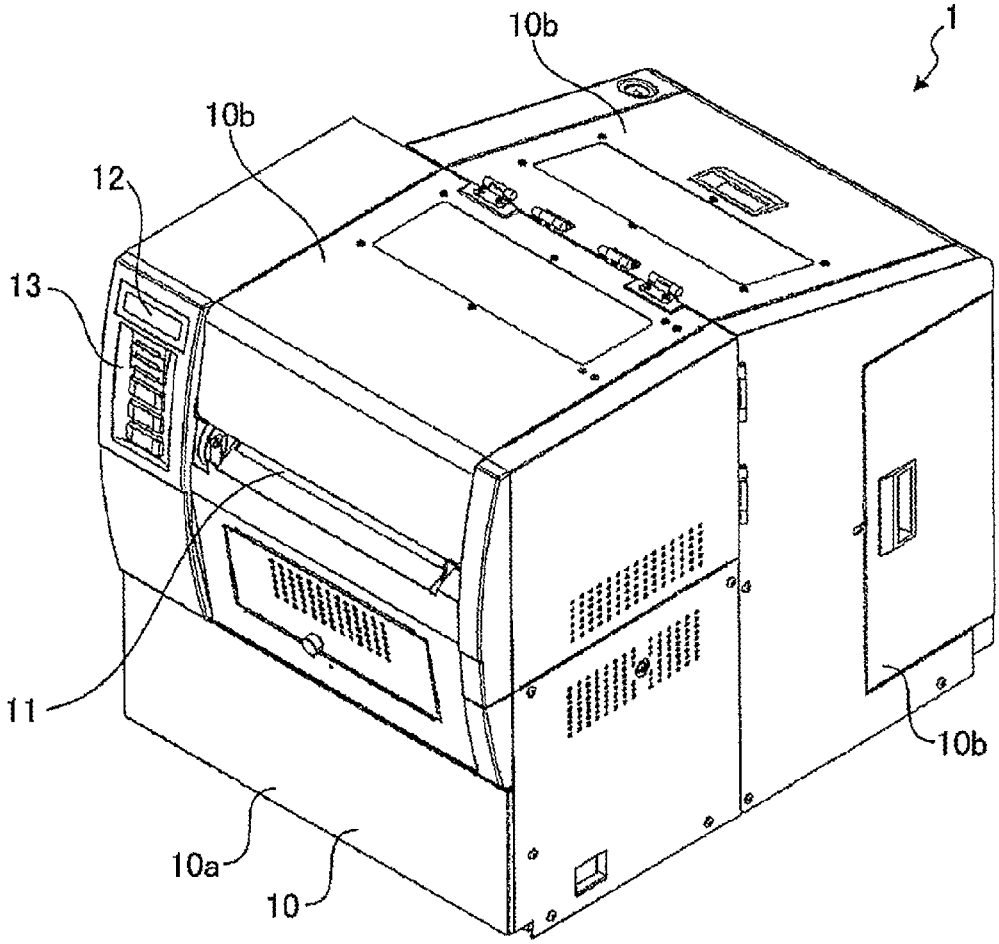
FIG. 1 is a perspective view showing the external appearance of a printer of a first embodiment.

As shown in FIG. 1, the printer 1 has a housing 10. A discharging portion 11 is arranged to discharge the rewritable printing medium 200 on a front-side wall of the housing 10. The discharging portion 11 is formed with an opening in the housing. A display 12, such as a liquid crystal display, and an operation panel 13 mounted with various buttons are arranged on the front-side wall of the housing 10. The housing 10 has a main body 10*a* and a plurality of cover portions 10*b* on the front-side wall of the housing 10. The cover portions 10*b* are connected to the main body 10*a* so that the cover portions 10*b* may pivot to be opened/closed with respect to the main body 10*a*. If the cover portions 10*b* are opened, the inside of the housing 10 is exposed.

Figure 3:
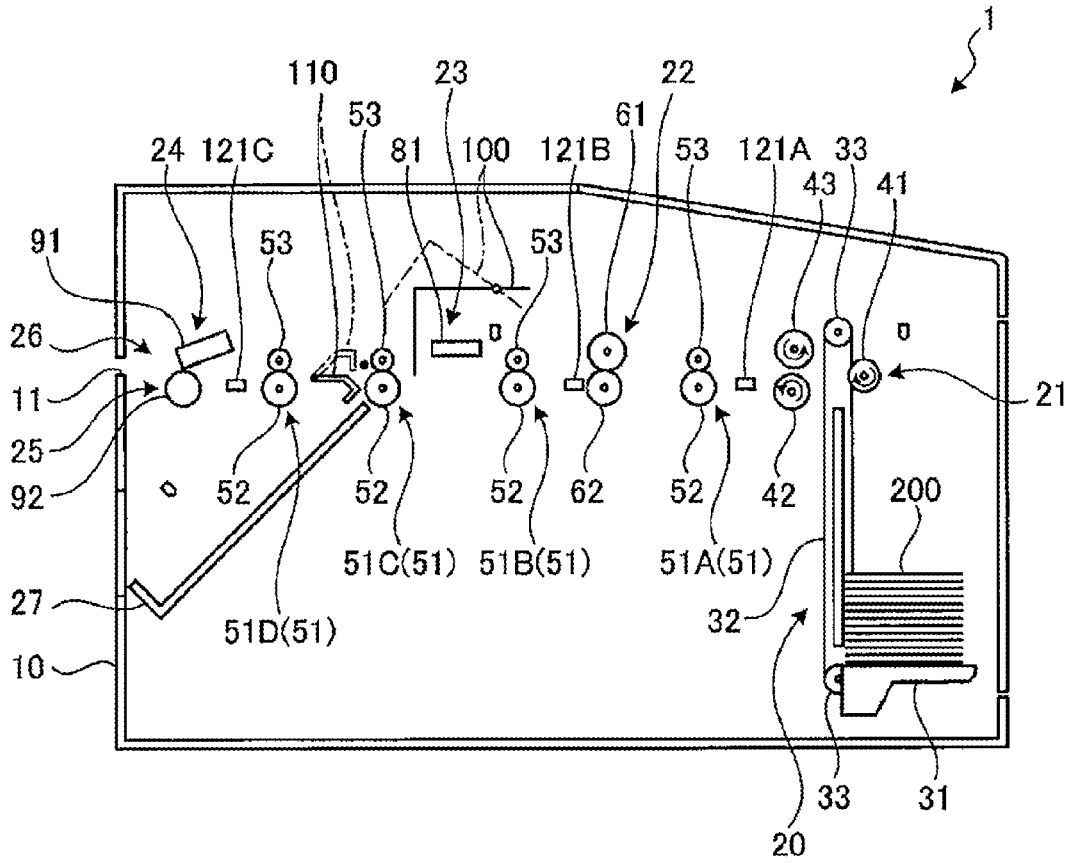
FIG. 3 is a vertical section view showing a printer.

As shown in FIG. 3, the printer 1 includes a medium storage unit 20 for stacking to store a plurality of rewritable printing media 200, a paper feeding unit 21 for picking up the rewritable printing medium 200 from the medium storage unit 20 one by one, an erasing unit 22 for erasing print by heating the rewritable printing medium 200, a wireless reader/writer 23 for wirelessly communicating with the wireless chip 200*b* of the rewritable printing medium 200, and a printing unit 24 for printing by heating the rewritable printing medium 200, inside the housing 10. The printer 1 further includes a conveying unit 25 for conveying the rewritable printing medium 200 from the medium storage unit 20 to the discharging portion 11. A conveying path 26, from the medium storage unit 20 to the discharging portion 11, is formed to include the paper feeding unit 21, the conveying unit 25, the wireless reader/writer 23, the erasing unit 22 and the printing unit 24. The side close to medium storage unit 20 of the conveying path 26 is referred to as the upstream side, and the side close to the discharging portion 11 of the conveying path 26 is referred to as the downstream side. A reject stacking unit 27 is arranged below the printing unit 24. The printer 1 includes a control unit 28 (see FIG. 5) for controlling respective parts of the printer 1.

The medium storage unit 20 includes a lifter 31, which is arranged to be able to vertically move upwards or downwards. The lifter 31 is able to load and support a plurality of rewritable printing media 200 in a stack state. The lifter 31 is connected to a lifting belt 32. The lifting belt 32 is wrapped over two pulleys 33. The pulleys 33 are connected to a lifting motor 34 (see FIG. 5), and the lifting motor 34 drives the pulleys 33 to rotate. In this structure, if the lifting motor 34 drives the pulleys 33 to rotate, the lifting belt 32 is conveyed to move the lifter 31 upwards or downwards. At this time, the lifter 31 moves upwards or downwards in accordance with the rotation direction of the lifting motor 34.

The paper feeding unit 21 is disposed in the upper portion of the medium storage unit 20. The paper feeding unit 21 feeds the rewritable printing medium 200 loaded atop the lifter 31 to the conveying unit 25 one by one.

The paper feeding unit 21 includes a pickup roller 41 disposed in the upper portion of the medium storage unit 20. The paper feeding unit 21 further includes a forward roller 42 and a backward roller 43, both of which are disposed in the downstream side close to the pickup roller 41. The pickup roller 41, the forward roller 42 and the backward roller 43 are connected to a paper feeding motor 44 (see FIG. 5) via an array of gears (not shown), so as to be driven to be rotated by the paper feeding motor 44.

The pickup roller 41 delivers the rewritable printing medium 200 atop the medium storage unit 20 to the downstream side of the conveying path 26. The forward roller 42 is arranged below the backward roller 43 opposite the backward roller 43. The forward roller 42 forms the bottom side of the conveying path. The forward roller 42 rotates in a direction where the rewritable printing medium 200 delivered from the pickup roller 41 is pushed forward to the downstream side of the conveying path 26. The backward roller 43 rotates in a direction where, if two rewritable printing media 200 are simultaneously delivered, the upper one of the two rewritable printing media 200 is pushed backward to the medium storage unit 20.

The conveying unit 25 conveys the rewritable printing medium 200 toward the discharging portion 11 along the conveying path 26. The conveying unit 25 includes a plurality of pairs of rollers 51 arranged along the conveying path 26. The plurality of pairs of rollers 51 are a first pair of rollers 51A, a second pair of rollers 51B, a third pair of rollers 51C, and a fourth pair of rollers 51D. If the first to fourth pairs of rollers 51A, 51B, 51C, and 51D are not described to be specifically distinguished, the first to fourth pairs of rollers 51A, 51B, 51C, and 51D will be described as the pairs of rollers 51.

Each pair of rollers 51 may be arranged among the paper feeding unit 21, the erasing unit 22, the wireless reader/writer 23, the printing unit 24, and the discharging portion 11. The first pair of rollers 51A is disposed between the paper feeding unit 21 and the erasing unit 22, and the second to fourth pairs of rollers 51B, 51C, and 51D are disposed between the erasing unit 22 and the printing unit 24.

Each pair of rollers 51 has a conveying roller 52 and a driven roller 53. The conveying roller 52 forms the bottom side of the conveying path 26. The driven roller 53 is disposed above the conveying roller 52, and forms the top side of the conveying path 26. The conveying roller 52 of the first pair of rollers 51A is connected to a first conveying motor 54 (see FIG. 5) via an array of gears, and the second to fourth pairs of rollers 51B, 51C, and 51D are connected to a second conveying motor 55 (see FIG. 5). For example, the first and second conveying motors 54 and 55 are stepping motors. The driven roller 53 is adjustable to be spaced from the conveying roller 52 in accordance with a thickness of the rewritable printing medium 200. The driven roller 53 is biased toward the conveying roller 52 by a bias member (not shown). The driven roller 53 is driven by the conveying roller 52. In the conveying unit 25, the first and second conveying motors 54 and 55 drives the conveying rollers 52 to rotate, so that the rewritable printing medium 200 is conveyed with the conveying roller 52 and the driven roller 53 interposed.

As shown in FIG. 3, the erasing unit 22 includes a heat roller 61 and a counter roller 62. The heat roller 61 is arranged opposite the counter roller 62 to form the conveying path 26. The erasing unit 22 presses the heat roller 61 to be in pressure contact with the rewritable printing medium 200, thereby erasing the print of the rewritable printing medium 200. The heat roller 61 is a heating body having a heat source. The heat roller 61 generates heat, so that the heat energy necessary for erasing the print of the rewritable printing medium 200 is applied to the rewritable printing medium 200. After the heat energy is applied, the rewritable printing medium 200 is slowly cooled. Consequently, the print of the rewritable printing medium 200 is erased.

The heat roller 61 is connected to the first conveying motor 54. The first conveying motor 54 drives the heat roller 61 to rotate, so that the rewritable printing medium 200 is conveyed toward the discharging portion 11. The heat roller 61 is included in the conveying unit 25.

Figure 4:
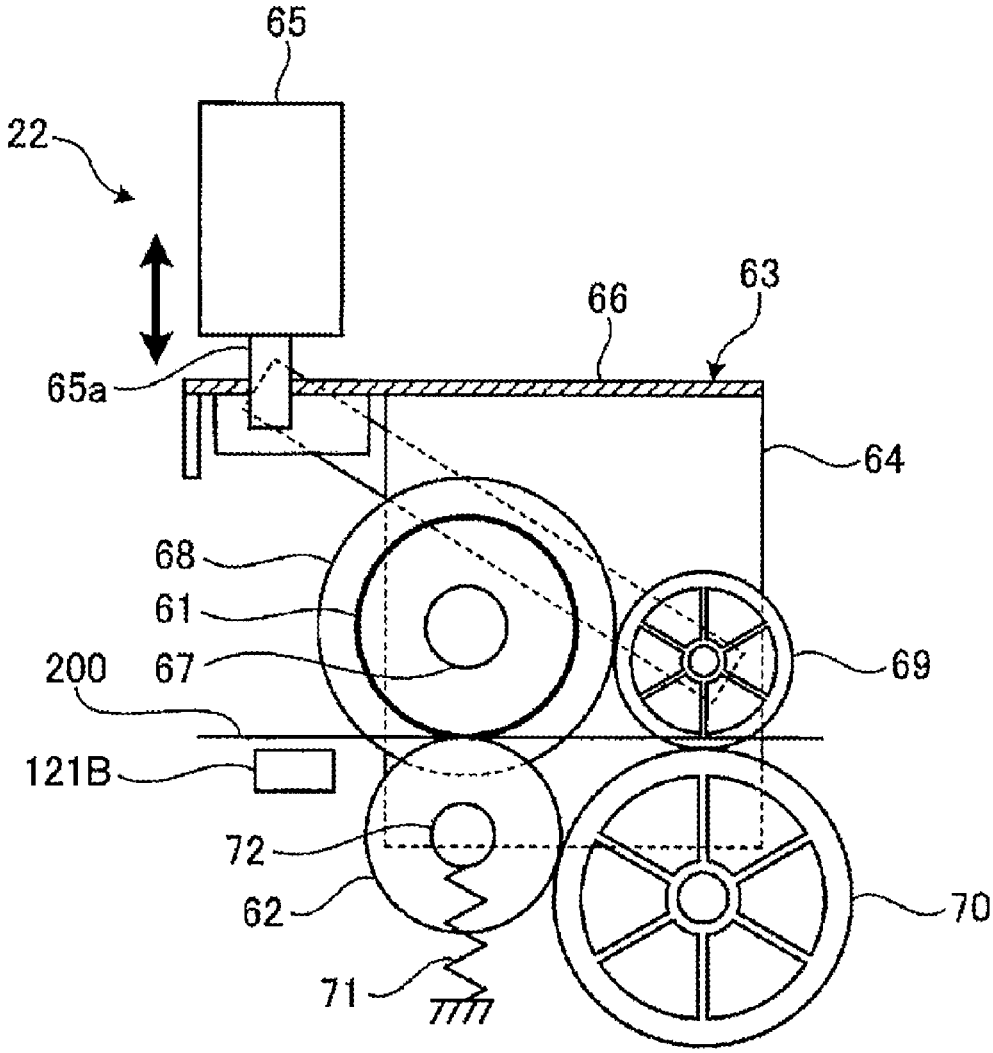
FIG. 4 is a side view showing an erasing unit.

The counter roller 62 is arranged opposite the heat roller 61, so that the rewritable printing medium 200 is interposed between the heat roller 61 and the counter roller 62. Specifically, as shown in FIG. 4, the counter roller 62 is arranged below the heat roller 61. The counter roller 62 is pivotably supported by a support shaft 72. The support shaft 72 is mounted to the housing 10 so that the support shaft 72 may be moved within a specified range for attaching or detaching the counter roller 62 from the heat roller 61. A spring 71, as a bias member, biases the support shaft 72 toward the heat roller 61. Thereby, the spring 71 biases the counter roller 62 toward the heat roller 61, so that the counter roller 62 is in contact with the heat roller 61. If the rewritable printing medium 200 is positioned between the heat roller 61 and the counter roller 62, the rewritable printing medium 200 becomes interposed between the heat roller 61 and the counter roller 62. The heat roller 61 drives the counter roller 62 to rotate.

As shown in FIG. 4, the erasing unit 22 has a support mechanism 63 as a pressure contact part, which presses the heat roller 61 to be in pressure contact with the rewritable printing medium 200. The support mechanism 63 supports the heat roller 61 so that the heat roller 61 may retract from the rewritable printing medium 200. That is, the support mechanism 63 supports the heat roller 61 so that the heat roller 61 may be moved to be apart from the counter roller 62.

Specifically, the support mechanism 63 includes a mobile part 64 and a first solenoid 65. The mobile part 64 is mounted with the heat roller 61. The first solenoid 65, as a drive unit, moves the mobile part 64 between a contact position (hereinafter, referred to as an initial position) where the heat roller 61 is pressed to be in pressure contact with the rewritable printing medium 200 and a non-contact position (hereinafter, referred to as a retract position) where the heat roller 61 is not pressed to be in pressure contact with the rewritable printing medium 200. In this respect, if the rewritable printing medium 200 is not interposed between the heat roller 61 and the counter roller 62, when the heat roller 61 is in the initial position, the heat roller 61 is pressed to be in pressure contact with the counter roller 62. And when the heat roller 61 is in the retract position, the heat roller 61 is apart from the counter roller 62. Further, when the heat roller 61 is in the initial position, the counter roller 62 is biased upwards by the spring 71 but locked from moving upwards by a lock member (not shown).

The mobile part 64 includes a frame 66 which rotatably supports the heat roller 61. Specifically, the heat roller 61 is fixed to a rotary shaft 67, and the rotary shaft 67 is pivotally supported by the frame 66, so that the frame 66 supports the heat roller 61 via the rotary shaft 67. Further, a solenoid pin 65*a* of the first solenoid 65 is fixed to the frame 66. With this structure, if the first solenoid 65 is not driven, the solenoid pin 65*a* is in the initial position, so that the heat roller 61 is in the initial position along with the frame 66. Thereby, the heat roller 61 is in pressure contact with the counter roller 62. When the rewritable printing medium 200 is conveyed to be between the heat roller 61 and the counter roller 62, the heat roller 61 presses the rewritable printing medium 200. In other words, the heat roller 61 is in pressure contact with the rewritable printing medium 200. On the other hand, if the first solenoid 65 is driven by the control unit 28, the first solenoid 65 moves the solenoid pin 65*a* upwards, so that the heat roller 61 is moved from the initial position to the retract position along with the frame 66. Thereby, the heat roller 61 is apart from the counter roller 62. When the rewritable printing medium 200 is interposed between the heat roller 61 and the counter roller 62, the heat roller 61 is apart from the rewritable printing medium 200.

A first gear 68 is fixed to the rotary shaft 67. The first gear 68 meshes with a second gear 69 rotatably supported by the frame 66. The second gear 69 meshes with a third gear 70 rotatably supported by the housing 10. The third gear 70 is connected to the first conveying motor 54 via another gear (not shown). Accordingly, the driving force of the first conveying motor 54 is transferred to the heat roller 61 via the third gear 70, the second gear 69, and the first gear 68. With this structure, if the first solenoid 65 moves the heat roller 61 along with the frame 66, the first and second gears 68 and 69 moves together with the frame 66. If the heat roller 61 is moved from the initial position to the retract position, the second gear 69 is apart from the third gear 70. If the heat roller 61 is moved from the retract position to the initial position, the second gear 69 meshes with the third gear 70.

As shown in FIG. 3, the wireless reader/writer 23 includes an antenna 81 and a wireless control circuit 82 for wirelessly communicating with the wireless chip 200*b* of the rewritable printing medium 200. The antenna 81 is disposed above the conveying path 26 between the erasing unit 22 and the printing unit 24. The wireless control circuit 82 is connected to the antenna 81 (see FIG. 5). For example, the wireless communication uses a radio wave for short-range communication used in RFID. Specifically, the antenna 81 may output a radio wave in a UHF band downward (toward the conveying path 26) to wirelessly short-range communicate with the wireless chip 200*b* of the rewritable printing medium 200. Under control of the controller 28, the wireless control circuit 82 outputs a radio wave through the antenna 81, so as to write print data to the wireless chip 200*b*. Additionally, under the control of the controller 28, the wireless control circuit 82 receives a radio wave from the wireless chip 200*b* through the antenna 81, so as to output information based on the radio wave to the CPU 131.

The printing unit 24 is arranged between the erasing unit 22 and the discharging portion 11 along the conveying path 26. The printing unit 24 prints the rewritable printing medium 200 by applying heat energy thereto. The printing unit 24 includes a thermal head 91 and a platen roller 92. The thermal head 91 includes heating elements (not shown). The heating elements of the thermal head 91 apply heat energy to the rewritable printing medium 200 in the conveying path 26, so that the rewritable printing medium 200 is printed. After the heat energy is completely applied, the rewritable printing medium 200 is rapidly cooled. As a result, the print in the rewritable printing medium 200 is fixed. The platen roller 92 is driven to rotate by the second conveying motor 55, so that the rewritable printing medium 200 is delivered to the discharging portion 11 while supported by the platen roller 92. The platen roller 92 forms the conveying unit 25.

A medium stopper 100 is disposed above the antenna 81 within the housing 103. The medium stopper 100 is arranged at the downstream side from the antenna 81. The medium stopper 100 is configured to rotate between a block position (indicated with the solid line in FIG. 3) where the conveying path 26 is blocked and an open position (indicated with the dashed-dotted line in FIG. 3) where the conveying path 26 is opened. The medium stopper 100 is biased from the block position to the open position by a spring (not shown). When the medium stopper 100 is in the open position, the medium stopper 100 is positioned by being put into contact with an abut member. The medium stopper 100 is connected to a stopping motor 101 (see FIG. 5) via a cam mechanism. The stopping motor 101 drives the cam mechanism to press the medium stopper 100, so that the medium stopper 100 is moved from the open position to the block position. If the press by the cam mechanism is released, the medium stopper 100 returns from the block position to the open position by the bias force of the spring. When the medium stopper 100 is in the block position, the medium stopper 100 confronts an end of the rewritable printing medium 200 being conveyed along the conveying path 26 at the downstream side, thereby stopping the rewritable printing medium 200. If the medium stopper 100 stops the rewritable printing medium 200, the wireless chip 200*b* within the rewritable printing medium 200 is positioned so as to reliably receive a radio wave output from the antenna 81 and reliably perform wireless short-range communication with the wireless reader/writer 23.

A reject gate 110 is arranged as a switching unit between the wireless reader/writer 23 and the printing unit 24 along the conveying path 26. The reject gate 110 is configured to move between a first position (indicated with the solid line in FIG. 3) where the rewritable printing medium 200 is guided to the printing unit 24 and a second position (indicated with the dashed-dotted line in FIG. 3) where the rewritable printing medium 200 is dropped to the reject stacking unit 27. The reject gate 110 is connected to a second solenoid 111 (see FIG. 5) via a connection mechanism (not shown). When the second solenoid 111 is not driven, the reject gate 110 is positioned in the first position. If the second solenoid 111 is driven, the reject gate 110 is moved to the second position by the second solenoid 111.

The printer 1 includes first to third medium detection sensors 121A, 121B, and 121C for detecting the rewritable printing medium 200 in the conveying path 26 within the housing 10.

The first medium detection sensor 121A is arranged between the paper feeding unit 21 and the erasing unit 22. Specifically, the first medium detection sensor 121A is arranged between the paper feeding unit 21 and the first pair of roller 51A. The second medium detection sensor 121B is disposed between the erasing unit 22 and the antenna 81 of the wireless reader/writer 23. Specifically, the second medium detection sensor 121B is disposed around the erasing unit 22 at the downstream side from the erasing unit 22. In other words, the second medium detection sensor 121B is disposed adjacent to the erasing unit 22 in the downstream side from the erasing unit 22. The third medium detection sensor 121C is arranged between the antenna 81 of the wireless reader/writer 23 and the printing unit 24. The medium detection sensors 121A, 121B, and 121C are transmissive or reflective-type, which uses light to detect the rewritable printing medium 200. It is assumed herein that the first to third medium detection sensors 121A, 121B, and 121C are reflective-type. The first to third medium detection sensors 121A, 121B, and 121C emits light toward the conveying path 26, and receive light reflected from the rewritable printing medium 200 conveyed along the conveying path 26. The medium detection sensors 121A, 121B, and 121C output electric signals to the control unit 28. The control unit 28 determines the presence/absence of the rewritable printing medium 200 on the conveying path 26 based on the electric signal.

Figure 5:
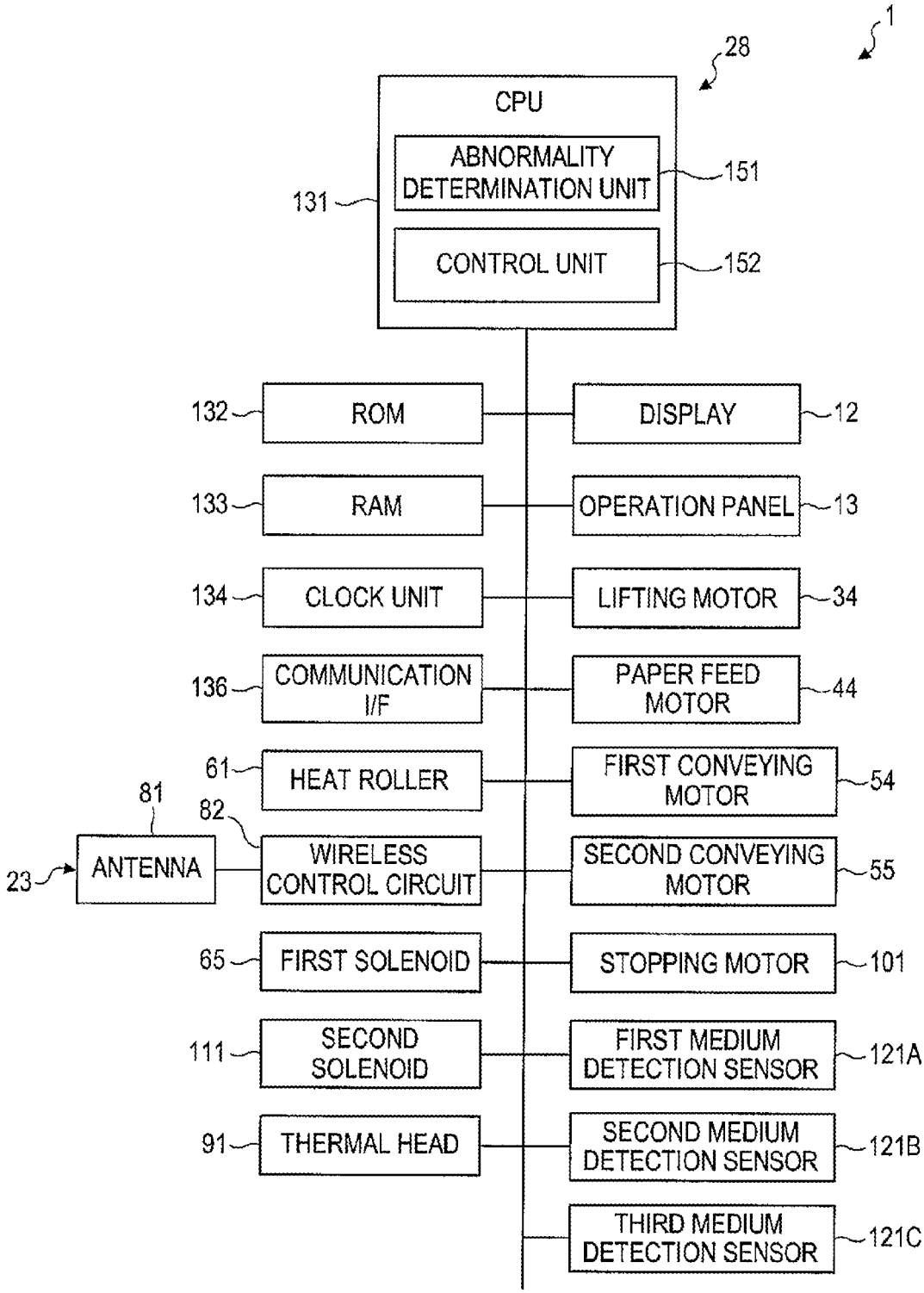
FIG. 5 is a block diagram showing an electric system of a printer.

As shown in FIG. 5, the control unit 28 includes a Central Processing unit (CPU) 131 for centrally controlling various arithmetic operations or respective parts of the printer 1, a Read Only Memory (ROM) 132 for storing various programs or various data, a Random Access Memory (RAM) 133 for temporarily storing various programs or various data, and a clock unit 134 for measuring the date and time. The CPU 131 is connected to the ROM 132, the RAM 133, and the clock unit 134 via a bus 135. Further, the CPU 131 is connected to a communication interface 136 (communication I/F in FIG. 5) via the bus 135, and the communication interface 136 allows the printer 1 to communicate with an external device (not shown) such as a host device.

The CPU 131 is connected to the display 12, the operation panel 13, the heat roller 61, the wireless reader/writer 23, the lifting motor 34, the paper feeding motor 44, the first and second conveying motors 54 and 55, the stopping motor 101, the first and second solenoids 65 and 111, the thermal head 91, and the first to third medium detection sensors 121A, 121B, and 121C via the bus 135 and various input/output circuits.

In the printer 1 with the above-described configuration, the paper feeding unit 21 delivers the rewritable printing medium 200 to the conveying path 26, and the conveying unit 25 conveys the rewritable printing medium 200 to the discharging portion 11. In the process of conveying the rewritable printing medium 200, the erasing unit 22 erases the print formed on the rewritable printing medium 200. Subsequently, the medium stopper 100 positions the rewritable printing medium 200, so that the wireless reader/writer 23 wirelessly communicates with the wireless chip 200*b* of the rewritable printing medium 200. For example, the wireless reader/writer 23 may write information to the wireless chip 200*b*. Subsequently, the printing unit 24 prints information on the rewritable printing medium 200. The printed rewritable printing medium 200 is discharged from the discharging portion 11. The printer 1 performs printing operations with respect to the rewritable printing medium 200 by the printing unit 24, along with performing erasing operations with respect to following rewritable printing medium 200 by the erasing unit 22, which is subsequently to be printed by the printing unit 24. That is, the printer 1 conveys a plurality of rewritable printing media 200 along the conveying path 26 and executes various processes with respect to the rewritable printing media 200. The printer 1 has a rewritable printing medium 200 to which a certain process is applied and a rewritable printing medium 200 awaiting a process in the conveying path 26.

After, a process for releasing a pressure contact, which is executed by the CPU 131 according to a program, will be described. If a conveyance failure of the rewritable printing medium 200 occurs due to a jam within the printer 1, the process releases the pressure contact of the heat roller 61 on the rewritable printing medium 200, so that a method for releasing a pressure contact of a heating body is implemented. In this process, the CPU 131 utilizes an determination unit 151 and a control unit 152 as functional units according to a program as shown in FIG. 5.

The determination unit 151 determines whether an abnormality occurs in the conveyance of the rewritable printing medium 200 by using the detection results of the first to third medium detection sensors 121A, 121B, and 121C.

If the determination unit 151 determines that the abnormality occurs, the control unit 152 controls the conveying unit 25 to forcibly discharge the rewritable printing medium 200 for releasing the pressure contact of the heat roller 61 on the rewritable printing medium 200. Specifically, if the determination unit 151 determines that the abnormality occurs, the control unit 152 determines whether the rewritable printing medium 200 is on the erasing unit 22 based on the detection results of the medium detection sensors 121A, 121B, and 121C. If the control unit 152 determines that the rewritable printing medium 200 is on the erasing unit 22, the control unit 152 controls the conveying unit 25 to forcibly discharge the rewritable printing medium 200 for releasing the pressure contact of the heat roller 61 on the rewritable printing medium 200. In the forcibly discharging operation, the rewritable printing medium 200 is conveyed toward the discharging portion 11 by the conveying roller 52, which is arranged between the erasing unit 22 and the discharging portion 11 along the conveying path 26. If the determination unit 151 determines that the abnormality does not occur, the control unit 152 does not control the conveying unit 25 for releasing the pressure contact of the heat roller 61 on the rewritable printing medium 200.

Figure 6:
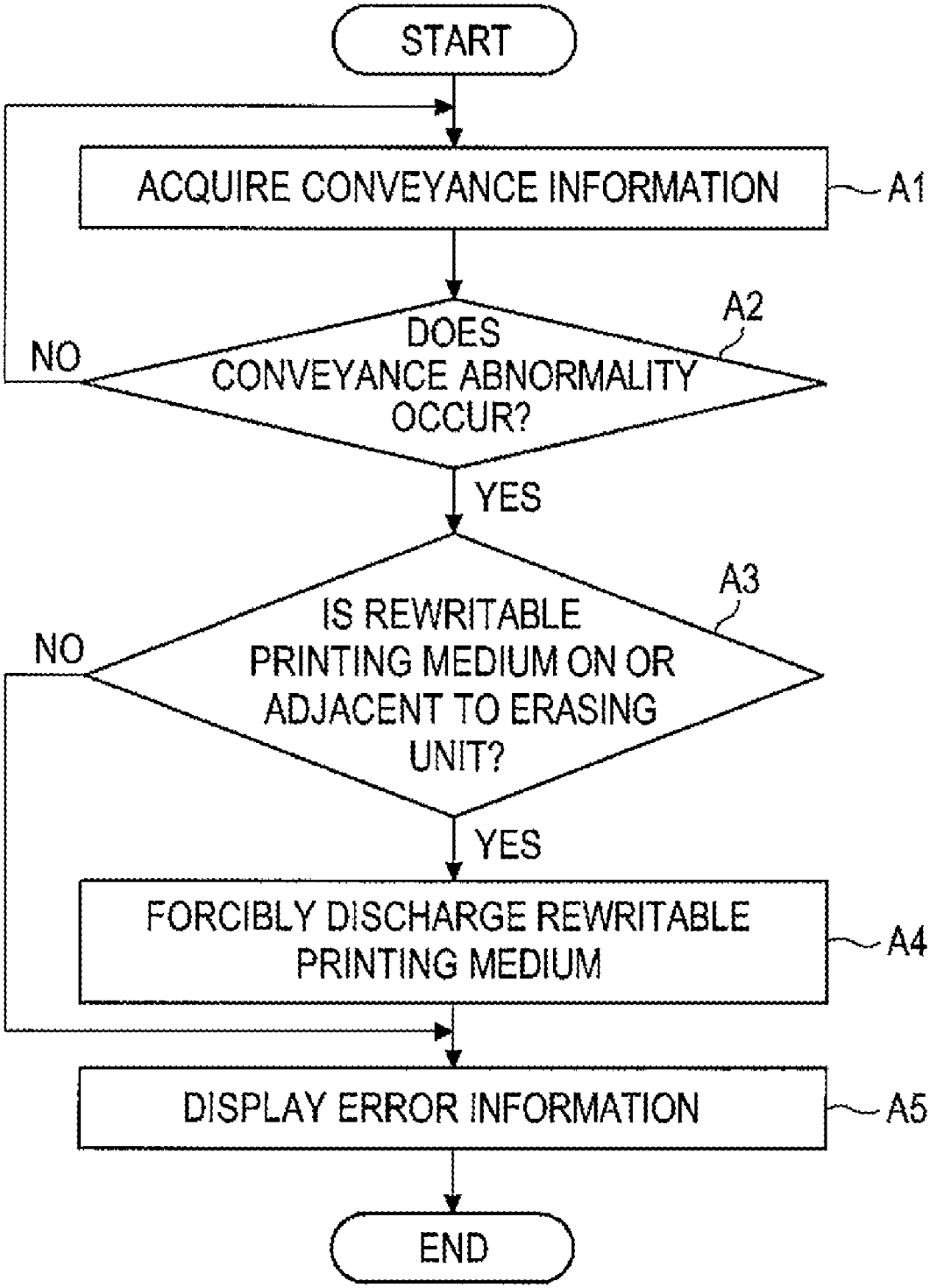
FIG. 6 is a flowchart showing the flow of a process executed by a CPU.

After, the flow of a process for releasing a pressure contact will be described with reference to the flowchart shown in FIG. 6. When various processes for erasing and printing are executed with respect to the rewritable printing medium 200, the CPU 131 acquires information regarding the conveyance of the rewritable printing medium 200 by the conveying unit 25 (Act 1). Specifically, in Act 1, the CPU 131 receives outputs from the respective medium sensors 121A, 121B, and 121C.

The CPU 131 determines whether an abnormality occurs in the conveyance of the rewritable printing medium 200 by the conveying unit 25 (Act 2: determination unit). For example, if the rewritable printing medium 200 passes through the first medium detection sensor 121A, it is determined whether the rewritable printing medium 200 passes through the second medium detection sensor 121B within a certain time. Or, if the rewritable printing medium 200 passes through the second medium detection sensor 121B, it is determined whether the rewritable printing medium 200 passes through the third medium detection sensor 1210 within a certain time. If the rewritable printing medium 200 passing through the first medium detection sensor 121A passes through the second medium detection sensor 121B within the certain time, or if the rewritable printing medium 200 passing through the second medium detection sensor 121B passes through the third medium detection sensor 121C within the certain time, the CPU 131 determines that the conveyance of the rewritable printing medium 200 is normal. On the other hand, if the rewritable printing medium 200 passing through the first medium detection sensor 121A fails to pass through the second medium detection sensor 121B within the certain time, or if the rewritable printing medium 200 passing through the second medium detection sensor 121B fails to pass through the third medium detection sensor 121C within the certain time, the CPU 131 determines that an abnormality occurs in the conveyance of the rewritable printing medium 200. The process of Acts 1 and 2 may be performed with a certain interval (NO of Act 2).

If the CPU 131 determines that the abnormality occurs in the conveyance of the rewritable printing medium 200 by the conveying unit 25 (YES of Act 2), the CPU 131 determines whether a rewritable printing medium 200 is on or adjacent to the erasing unit 22 (Act 3). Specifically, the CPU 131 uses output signals of the first and second medium detection sensors 121A and 121B acquired in Act 1 to determine whether there is a rewritable printing medium 200 which passes through the first medium detection sensor 121A but fails to pass through the second medium detection sensor 121B.

If the CPU 131 determines that the rewritable printing medium 200 is on the erasing unit 22 (YES of Act 3), the CPU 131 causes the conveying unit 25 to perform the forcibly discharging operation, so that the rewritable printing medium 200 in the downstream side of the conveying path 26 is forcibly discharged from the erasing unit 22 (Act 4). Specifically, the CPU 131 forwardly rotates all the pairs of rollers 51, the heat roller 61, and the platen roller 92 for a certain time. For example, if the conveyance fails due to a slip of the conveying unit 25, the slip may be solved by a forcibly discharging operation of the conveying unit 25, so that the rewritable printing medium 200 is forcibly discharged from the discharging portion 11. At this time, the rewritable printing medium 200 in pressure contact with the heat roller 61 can be apart from the heat roller 61. Then, the CPU 131 proceeds to Act 5. If the CPU 131 determines that rewritable printing medium 200 is not on the erasing unit 22 in Act 3 (NO of Act 3), the CPU 131 directly proceeds to Act 5.

In Act 5, the CPU 131 causes the display 12 to display error information indicating that an abnormality occurs in conveying the rewritable printing medium 200.

Figure 7:
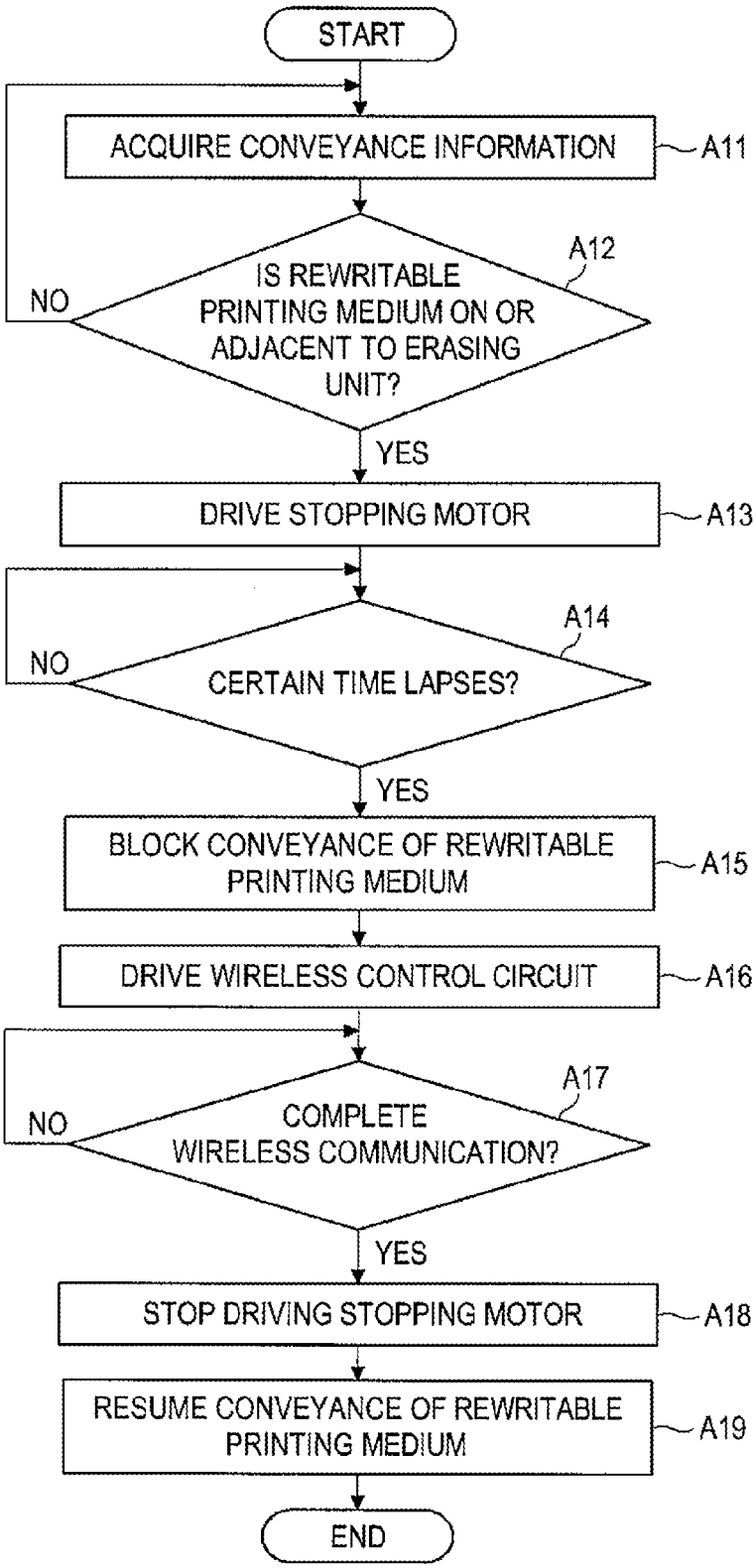
FIG. 7 is a flow chart showing the flow of a process executed by a CPU.

FIG. 7 is a flow chart for controlling a medium stopper, which is executed by the CPU 131 according to a program.

The CPU 131 receives output from respective first to third medium detection sensors 121A, 121B, and 121C, so as to acquire information regarding the conveyance of the rewritable printing medium 200 (Act 11). And, if the CPU 131 detects that rewritable printing medium 200 passes through the erasing unit 22 (Act 12), the CPU 131 drives the stopping motor 101 (Act 13). Thereby, the medium stopper 100 is moved against the spring to be positioned in a block position. After a certain time lapses until the rewritable printing medium 200 reaches the stopper (Act 14), the conveyance of the rewritable printing medium 200 is blocked (Act 15). At this point, the wireless chip 200*b* within the rewritable printing medium 200 is positioned for communicating. Accordingly, the CPU 131 drives the wireless control circuit 82 to communicate with the wireless chip 200*b* (Act 16). After the CPU 131 completes communicating with the wireless chip 200*b* (Act 17), the CPU 131 stops driving the stopping motor 101 (Act 18). Then, the medium stopper 100 is positioned in the open position by the force of the spring, so that the conveyance of the rewritable printing medium 200 is resumed (Act 19).

In other embodiments, if the determination unit 151 determines that an abnormality occurs, the control unit 152 controls the conveying unit 25 to forcibly discharge the rewritable printing medium 200 for releasing the pressure contact of the heat roller 61 on the rewritable printing medium 200. Thus, for example, if a conveyance abnormality occurs due to a slip of the conveying roller 52 in the printer 1, the forcibly discharging operation of the conveying unit 25 may solve the slip, so that the rewritable printing medium 200 may be forcibly discharged. Thereby, the rewritable printing medium 200 is not subject to a large amount of heat from the heat roller 61, which allows the rewritable printing medium 200 to avoid abnormal bend and/or deformation. Further, this also allows the rewritable printing medium 200 to avoid abnormal coloration, which occurs when the rewritable printing medium 200 receives a large amount of heat from the heat roller 61. In embodiments, in that the rewritable printing medium 200 has the wireless chip 200*b*, the rewritable printing medium 200 is relatively expensive. However, the rewritable printing medium 200 can avoid abnormality, so that an increase in cost for running the printer 1 may be curbed.

In alternate embodiments, if the determination unit 151 determines that an abnormality occurs, the control unit 152 determines whether a rewritable printing medium 200 is on the erasing unit 22 based on the detection results of the medium detection sensors 121A, 121B, and 121C. When the control unit 152 determines that the rewritable printing medium 200 is on the erasing unit 22, the control unit 152 controls the conveying unit 25 to forcibly discharge the rewritable printing medium 200 for releasing the pressure contact of the heat roller on the rewritable printing medium 200. Thus, the occurrence of an abnormality in a rewritable printing medium 200 may be efficiently suppressed even if a conveyance abnormality occurs in the printer 1.

In other embodiments, the conveying unit 25 has a plurality of conveying rollers 52 disposed along the conveying path 26. If the determination unit 151 determines that an abnormality occurs, the control unit 152 controls the conveying rollers 52, which is located between the erasing unit 22 and the discharging portion 11 along the conveying path 26, to convey the rewritable printing medium 200 in the conveying path 26 toward the discharging portion 11. Accordingly, the conveying operation (forcibly discharging operation) of the conveying roller 52 discharges the rewritable printing medium 200 through the discharging portion, thereby suppressing an abnormality in the rewritable printing medium 200.

Second Embodiment

Figure 8:
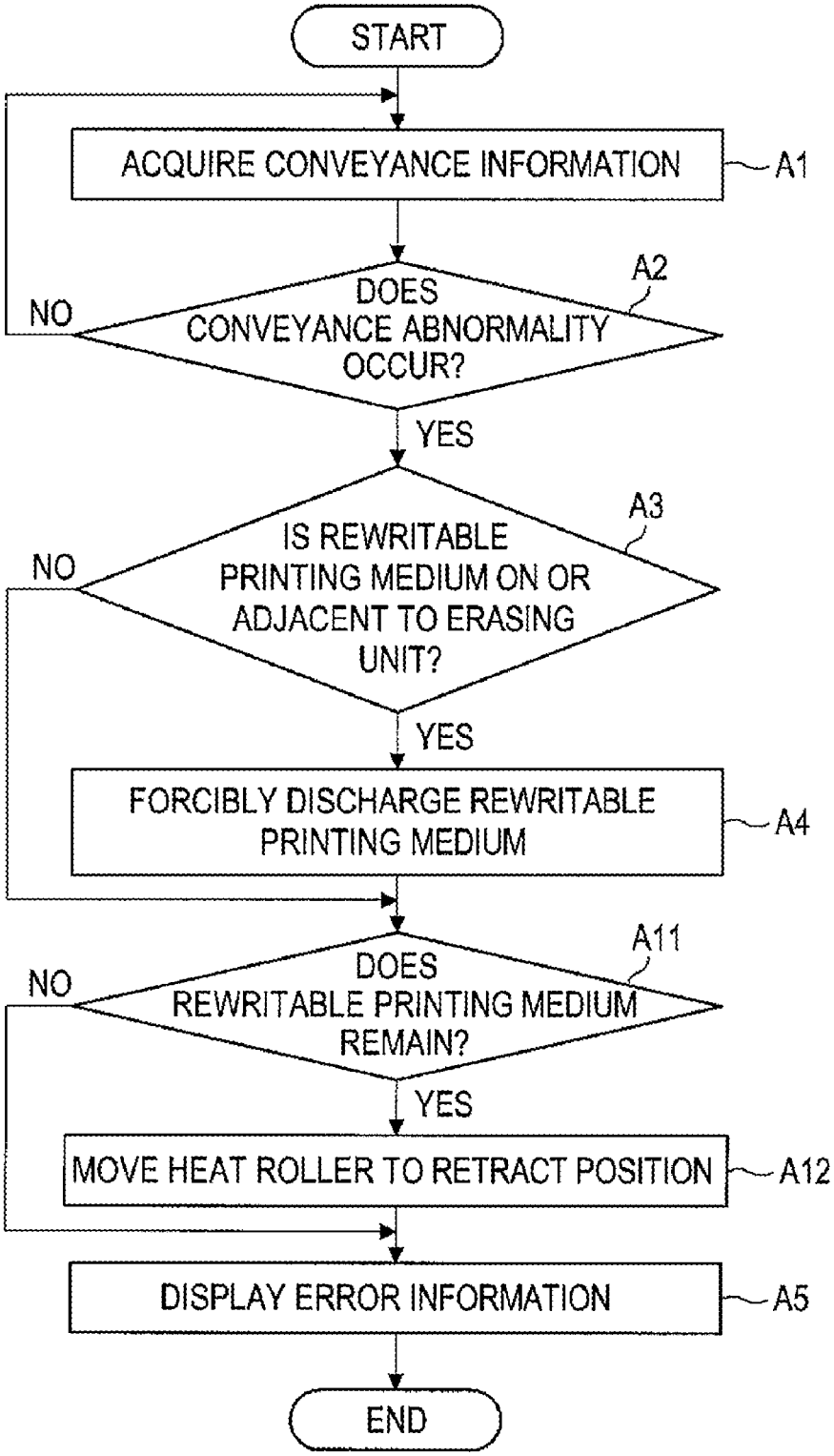
FIG. 8 is a flowchart showing the flow of a process executed by a CPU according to a second embodiment.

Next, a second embodiment will be described with reference to FIG. 8.

A process executed by the CPU 131 for releasing a pressure contact in this embodiment is different from that of the first embodiment. In this embodiment, if the determination unit 151 (see FIG. 5) determines that an abnormality occurs, the control unit 152 (see FIG. 5) also controls the support mechanism 63, which operates as the pressure contact unit, as well as the conveying unit 25 for releasing the pressure contact of the heat roller 61 on the rewritable printing medium 200. The support mechanism 63 performs a heat source retract operation, wherein the heat roller 61 is moved to be apart from the rewritable printing medium 200, for releasing the pressure contact of the heat roller 61 on the rewritable printing medium 200.

This process will be described with reference to the basis of the flowchart of FIG. 8. The flowchart of FIG. 8 is generally consistent with the flowchart of FIG. 6 except added Acts 11 and 12. The processing of Acts 1, 2, 3, 4, and 5 is consistent with that of the flowchart of FIG. 6, and therefore description thereof is omitted for sake of simplicity. In this embodiment, as shown in the flowchart of FIG. 8, the CPU 131 determines whether a rewritable printing medium 200 remains in the conveying path 26 after Act 4 (Act 11). For this determination, the CPU 131 uses output signals of the first to third medium detection sensors 121A, 121B, and 121C. Specifically, the CPU 131 determines whether the rewritable printing medium 200 passing through the first and second medium detection sensors 121A and 121B passes through the third medium detection sensor 121C. If the CPU 131 determines that the rewritable printing medium 200 passes through the first and second medium detection sensors 121A and 121B and further passes through the third medium detection sensor 121C, the CPU 131 determines that the rewritable printing medium 200 does not remain in the conveying path 26. On the other hand, if the CPU 131 determines that the rewritable printing medium 200 passes through the first and second medium detection sensors 121A and 121B but fails to pass through the third medium detection sensor 121C, the CPU 131 determines that the rewritable printing medium 200 remains in the conveying path 26.

When the CPU 131 determines that the rewritable printing medium 200 remains in the conveying path 26 (YES of Act 11), the CPU 131 controls the support mechanism 63 for releasing the pressure contact on the rewritable printing medium 200 (Act 12). Specifically, the CPU 131 drives the first solenoid 65 to move the heat roller 61 from the initial position to the retract position. Thereby, if the heat roller 61 is in pressure contact with the rewritable printing medium 200, the heat roller 61 separates from the rewritable printing medium 200, so that the pressure contact is released. Then, the CPU 131 proceeds to Act 5. On the other hand, if the CPU 131 determines that the rewritable printing medium 200 does not remain in the conveying path 26 (NO of Act 11), the CPU 131 directly proceeds to Act 5 without executing the process of Act 12. If the determination unit 151 determines that an abnormality does not occur, the control unit 152 operates both the conveying unit 25 and the erasing unit 22 for releasing the pressure contact of the heat roller 61 on the rewritable printing medium 200. That is, the conveying unit 25 does not perform the forcibly discharging operation, and the erasing unit 22 does not perform the heat source retract operation.

In this embodiment as described above, the support mechanism 63, as the pressure contact unit, supports the heat roller 61 so that the heat roller 61 is separated from the rewritable printing medium 200. If the determination unit 151 determines that the abnormality occurs, the control unit 152 controls the support mechanism 63 to move the heat roller 61 to be separated from the rewritable printing medium 200. Thereby, the rewritable printing medium 200 is not subject to a large amount of heat of the heat roller 61, which allows the rewritable printing medium to avoid abnormal bend and/or deformation. That is, according to this embodiment, the occurrence of an abnormality in the rewritable printing medium 200 may be suppressed even if a conveyance abnormality occurs in the printer 1.

In this embodiment, the support mechanism 63 includes the mobile part 64 and the first solenoid 65. The mobile part 64 is mounted with the heat roller 61. The first solenoid 65, as a drive unit, moves the mobile part 64 between a position where the heat roller 61 is in pressure contact with the rewritable printing medium 200 and a position where the heat roller 61 is not in pressure contact with the rewritable printing medium 200. Accordingly, the first solenoid 65 may detach the heat roller 61 from the rewritable printing medium 200.

The present invention is not limited to the above-described embodiments, and may adopt various embodiments in the scope without departing from the subject matter of the invention. It is described herein that if the determination unit determines that an abnormality occurs, the control unit controls only the conveying unit or both the conveying unit and the erasing unit for releasing the pressure contact of the heat roller on a rewritable printing medium (the conveying unit performs the forcibly discharging operation and the erasing unit performs the heat source retract operation), but the present invention is not limited thereto. The control unit may control the erasing unit to release the pressure contact of the heat roller on a rewritable printing medium. That is, if the determination unit determines that an abnormality occurs, the control unit controls at least one of the erasing unit and the conveying unit for releasing the pressure contact of the heat roller on a rewritable printing medium.

It is described herein that the spring biases the counter roller toward the heat roller, but the present invention is not limited thereto. For example, the spring may bias the heat roller toward the counter roller. Also, a peripheral portion of at least one of the counter roller and the heat roller may include an elastic member in place of the spring. Alternatively, the spring and the elastic member may be appropriately combined.

It is described herein that if the mobile part 64 is in the retract position, the heat roller is positioned to be apart from the rewritable printing medium, but the present invention is not limited thereto. Instead, the heat roller may be in contact with the rewritable printing medium in this case.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS(Operating System) or the like in the apparatus.

While certain embodiments have been described, these embodiments have been presented by way of example only and are not intended to limit the scope of the inventions. Indeed, the novel methods and apparatus described herein may be embodied in a variety of other forms; furthermore, various omissions, substitutions and changes in the form of the methods and apparatus described herein may be made without departing from the spirit of the inventions. The accompanying claims and their equivalents are intended to cover such forms or modifications as would fall within the scope and spirit of the inventions.

What is claimed is:

1. A printer comprising:

a conveying unit configured to convey a rewritable printing medium along a conveying path, the rewritable printing medium being erasable and printable by applying heat energy to the rewritable printing medium;

an erasing unit including a heating body, the erasing unit configured to erase print of the rewritable printing medium by pressing the heating body to be in pressure contact with the rewritable printing medium;

a printing unit located on a downstream side of the erasing unit along the conveying path, the printing unit configured to print the rewritable printing medium by applying heat energy to the rewritable printing medium;

a determination unit configured to determine whether an abnormality occurs in conveyance of the rewritable printing medium; and a control unit configured to control at least one of the erasing unit and the conveying unit for releasing the pressure contact of the heating body on the rewritable printing medium, if the determination unit determines that an abnormality occurs.

2. The printer of claim 1, wherein if the determination unit determines that an abnormality occurs, the control unit is configured to determine whether the rewritable printing medium is on the erasing unit, and if the control unit determines that the rewritable printing medium is on the erasing unit, the control unit is configured to control at least one of the erasing unit and the conveying unit for releasing the pressure contact of the heating body on the rewritable printing medium.

3. The printer of claim 1, wherein the conveying unit comprises a plurality of conveying rollers located between the erasing unit and a discharging portion along the conveying path, and wherein the control unit is configured to control the plurality of conveying rollers to convey the rewritable printing medium toward the discharging portion along the conveying path, if the determination unit determines that an abnormality occurs.

4. The printer of claim 1, wherein the erasing unit includes a pressure contact unit for pressing the heating body to be in pressure contact with the rewritable printing medium, and wherein the control unit is configured to control the erasing unit so that the pressure contact unit releases the pressure contact of the heating body, if the determination unit determines that an abnormality occurs.

5. The printer of claim 4, wherein the pressure contact unit is configured to support the heating body so that the heating body is movable to be apart from the rewritable printing medium, and wherein the control unit is configured to control the pressure contact unit to move the heating body to be apart from the rewritable printing medium, if the determination unit determines that an abnormality occurs.

6. The printer of claim 5, wherein the pressure contact unit includes a solenoid and the control unit is configured to control the solenoid to move the heating body to be apart from the rewritable printing medium.

7. The printer of claim 1, wherein the rewritable printing medium includes a wireless chip, and the printer further comprises:

a wireless reader/writer configured to wirelessly communicate with the wireless chip of the rewritable printing medium.

8. The printer of claim 7, further comprising:

a reject gate located between the wireless reader/writer and the printing unit along the conveying path and a reject stacking unit located below the printing unit, the reject gate configured to switch between a first position where the rewritable printing medium is guided to the printing unit and a second position where the rewritable printing medium is dropped to the reject stacking unit.

9. The printer of claim 7, further comprising:

a medium stopper disposed on a downstream side of the wireless reader/writer, the medium stopper configured to block the rewritable printing medium being conveyed along the conveying path, so that the wireless chip within the rewritable printing medium is positioned to wirelessly communicate with the wireless reader/writer.

10. A printer for printing a rewritable printing medium, the printer comprising:

a conveying unit configured to convey the rewritable printing medium, the rewritable printing medium comprising a wireless chip;

a media detection sensor configured to detect the rewritable printing medium;

a wireless reader/writer configured to wirelessly communicate with the wireless chip of the rewritable printing medium; and a medium stopper configured to block the rewritable printing medium being conveyed based on the detection result of the media detection sensor, so that the wireless chip within the rewritable printing medium is positioned to wirelessly communicate with the wireless reader/writer.

11. A method for releasing a pressure contact of a heating body in a printer, the printer including a conveying unit for conveying a rewritable printing medium along a conveying path, the rewritable printing medium being erasable and printable by applying heat energy to the rewritable printing medium, an erasing unit configured to erase print of the rewritable printing medium by pressing the heating body to be in pressure contact with the rewritable printing medium, and a printing unit arranged along the conveying path, the printing unit configured to print the rewritable printing medium by applying heat energy to the rewritable printing medium, the method comprising:

determining, by a determination unit, whether an abnormality occurs in conveyance of the rewritable printing medium; and controlling, by a control unit, at least one of the erasing unit and the conveying unit for releasing the pressure contact of the heating body on the rewritable printing medium, if the determination unit determines that an abnormality occurs.

12. The method of claim 11, wherein the controlling comprises determining whether the rewritable printing medium is on the erasing unit, if the determination unit determines that an abnormality occurs, and the controlling comprises controlling at least one of the erasing unit and the conveying unit for releasing the pressure contact of the heating body on the rewritable printing medium, if the control unit determines that the rewritable printing medium is on the erasing unit.

13. The method of claim 11, wherein the conveying unit includes a plurality of conveying rollers arranged between the erasing unit and a discharging portion along the conveying path, and wherein the controlling comprises controlling, by the control unit, the plurality of conveying rollers to convey the rewritable printing medium toward the discharging portion along the conveying path, if the determination unit determines that an abnormality occurs.

14. The method of claim 11, wherein the erasing unit includes a pressure contact unit for pressing the heating body to be in pressure contact with the rewritable printing medium, and wherein the controlling comprises controlling the erasing unit so that the pressure contact unit releases the pressure contact of the heating body, if the determination unit determines that an abnormality occurs.

15. The method of claim 14, wherein the pressure contact unit supports the heating body so that the heating body is movable to be apart from the rewritable printing medium, and wherein the controlling comprises controlling the pressure contact unit to move the heating body to be apart from the rewritable printing medium, if the determination unit determines that an abnormality occurs.

16. The method of claim 15, wherein the pressure contact unit includes a solenoid and the controlling comprises moving the solenoid to move the heating body to be apart from the rewritable printing medium.

17. The method of claim 11, wherein the rewritable printing medium includes a wireless chip.

18. The method of claim 17, wherein the printer further comprises a wireless reader/writer, and the method further comprises wirelessly communicating, by the wireless reader/writer, with the wireless chip of the rewritable printing medium.

19. The method of claim 18, wherein the printer further comprises a reject gate arranged between the wireless reader/writer and the printing unit along the conveying path and a reject stacking unit arranged below the printing unit, the method further comprising:

switching, by the reject gate, between a first position where the rewritable printing medium is guided to the printing unit and a second position where the rewritable printing medium is dropped to the reject stacking unit.

20. The method of claim 18, wherein the printer further comprises a medium stopper disposed on a downstream side of the wireless reader/writer, and the method further comprises:

blocking, by the medium stopper, the rewritable printing medium being conveyed along the conveying path, so that the wireless chip within the rewritable printing medium is positioned to wirelessly communicate with the wireless reader/writer.

* * * * *